US006315847B1

(12) United States Patent
Lee et al.

(10) Patent No.: US 6,315,847 B1
(45) Date of Patent: Nov. 13, 2001

(54) WATER-FREE PREPARATION OF IGNITER GRANULES FOR WATERLESS EXTRUSION PROCESSES

(75) Inventors: Kenneth E. Lee, No. Ogden, UT (US); Gary K. Lund, Malad, ID (US); Daniel W. Doll, No. Ogden, UT (US)

(73) Assignee: Cordant Technologies Inc., Salt Lake City, UT (US)

( * ) Notice: Subject to any disclaimer, the term of this patent is extended or adjusted under 35 U.S.C. 154(b) by 0 days.

(21) Appl. No.: 09/492,530

(22) Filed: Jan. 27, 2000

Related U.S. Application Data

(60) Provisional application No. 60/117,862, filed on Jan. 29, 1999.

(51) Int. Cl.[7] ..... D03D 23/00; C06B 31/02; C06B 45/10

(52) U.S. Cl. ..... 149/109.6; 149/108.6; 149/19.4; 149/61

(58) Field of Search ..... 149/19.4, 61, 108.6, 149/109.6; 102/202, 205

(56) References Cited

U.S. PATENT DOCUMENTS

| | | | | |
|---|---|---|---|---|
| 2,115,047 | | 4/1938 | Stevenson et al. . | |
| 2,988,438 | | 6/1961 | Allovio . | |
| 3,017,300 | | 1/1962 | Herring et al. . | |
| 3,062,147 | | 11/1962 | Davis et al. | 102/70 |
| 3,138,501 | | 6/1964 | Wright . | |
| 3,652,350 | | 3/1972 | Timmermans . | |
| 3,667,396 | * | 6/1972 | Barrett | 102/101 |
| 3,671,515 | | 6/1972 | Cox et al. | 260/223 |
| 3,899,973 | | 8/1975 | Brocart | 102/27 R |
| 3,917,767 | | 11/1975 | Eich et al. . | |
| 3,956,038 | | 5/1976 | Duguet et al. . | |
| 4,179,992 | * | 12/1979 | Ramnarace et al. | 102/45 |
| 4,361,526 | | 11/1982 | Allen . | |
| 4,377,678 | * | 3/1983 | Fukuma et al. | 528/75 |
| 4,384,903 | | 5/1983 | Enever | 149/7 |
| 4,405,534 | | 9/1983 | Deisenroth | 264/3 C |
| 4,979,999 | | 12/1990 | Briere | 149/6 |
| 5,061,409 | | 10/1991 | Dillehay et al. . | |
| 5,156,779 | | 10/1992 | McGowan | 264/3.3 |
| 5,565,651 | | 10/1996 | Kim et al. | 149/19.92 |
| 5,600,088 | | 2/1997 | Oberth | 149/11 |
| 5,759,458 | | 6/1998 | Haaland et al. . | |

FOREIGN PATENT DOCUMENTS 0 728 632 A1 8/1996 (EP) .

OTHER PUBLICATIONS

John Wiley & Sons, "Encyclopedia Of Polymer Science And Engineering", vol. 6, Emulsion Polymerization to Fibers, Manufacture, pp. 570–631.

Kirk–Othmer, Encyclopedia of Chemical Technology, Fourth Edition, vol. 20, Power Generation To Recycling, Glass, pp. 680–697.

* cited by examiner

*Primary Examiner*—Michael J. Carone
*Assistant Examiner*—Aileen J. Baker

(57) ABSTRACT

This substantially water-free method for preparing high density igniter granules involves uniformly coating fuel and oxidizer particulates dispersed in a non-solvent with a thermoplastic elastomer solution to produce coated igniter granules exhibiting substantially uniform size and shape distributions. The coated igniter granules are especially useful for waterless extrusion into igniters for automobile gas generating inflation devices, solid propellant rocket motors, and thrust decoys.

20 Claims, 6 Drawing Sheets

WATER-FREE PREPARATION OF IGNITER GRANULES FOR WATERLESS EXTRUSION PROCESSES

Priority is claimed on U.S. provisional application No. 60/117,862 filed in the U.S. Patent & Trademark Office on Jan. 29, 1999, the complete disclosure of which is incorporated herein by reference.

BACKGROUND OF THE INVENTION

1. Field of the Invention

This invention relates to a method for the preparation of high density igniter granules, and in particular to the substantially water-free preparation of high density igniter granules, which igniter granules are especially suitable for use in waterless extrusion applications.

2. Description of Related Art

Among the various applications in which thermoplastic elastomer-coated igniters extruded from granules may be employed are, by way of example, air bag assemblies, pyrotechnic ordinances, flares, thrust decoys, and solid propellant rocket motors. Especially suited for these applications are igniter compositions comprising boron/potassium nitrate ($B/KNO_3$) as the fuel/oxidizer ingredients. When ignited, the igniters initiate combustion of the larger specified gas generant composition.

Processes for preparing igniter granules are disclosed in U.S. Pat. Nos. 4,405,534 to Deisenroth and 5,565,651 to Kim, the disclosures of which are incorporated herein by reference to the extent that these disclosures are compatible with this invention. The Deisenroth patent discloses a process in which a crystalline water-insoluble explosive is incorporated into a fully reacted aqueous polyurethane dispersion that is substantially free of organic solvent to form a uniform mixture. The mixture is then coagulated to form granules, which are dried. The process disclosed in the Kim patent differs from that of Deisenroth, yet similarly involves the use of an aqueous solution.

The presence of water in the above-discussed processes imparts the processes with several drawbacks. In particular, water-sensitive materials that are soluble in water, such as $B/KNO_3$, cannot be effectively granulated by these water-intensive processes. Additionally, other water-sensitive materials, such as magnesium compounds, may produce volatile and explosive by-products when exposed to water.

A water-free process for preparing igniter granules is disclosed in U.S. Pat. No. 4,979,999 to Briere, the disclosure of which is incorporated herein by reference to the extent that it is compatible with this invention. According to the process disclosed in Briere, a binder is first dissolved in a solvent to form a binder solution. Ignitable magnesium particles are then added to the binder solution, and thereafter a non-solvent is introduced into the solution. However, the addition of ignitable particles to the binder solution before introducing the non-solvent to the ignitable particles causes a paste to form. Drawbacks associated with paste include the need to subject the paste to additional processing steps and equipment, such as an oven heater and a mesh sieve. Moreover, the igniter granules produced by this conventional technique typically are characterized by poorly distributed coatings, irregular shapes and a wide distribution of granule sizes, typically between approximately 0.1 mm to 1 mm. The lack of uniformity in granule coating, configuration, and dimension makes the igniter granules more sensitive to impact, friction, and electrical static discharge (ESD).

Thus, it would be a significant advancement in the art to provide a substantially water-free method for making uniformly coated extrudable igniter granules of substantially uniform shape and size without the need for either oven drying to evaporate water or complicated distillation processes to distill organic solvents.

SUMMARY OF THE INVENTION

It is, therefore, an object of this invention to provide a process which achieves the above-discussed advancement in the art for producing igniter granules of uniform configuration, coating, and dimension and suitable for subsequent waterless extrusion.

In accordance with the principles of this invention, this and other objects are attained by the provision of a process comprising dispersing at least fuel and oxidizer particles (also referred to herein as particulates or ignitable particles), at least one of which is water-sensitive and can be a powder, into a first liquid comprising at least one first non-solvent to form a slurry that is substantially water-free. As referred to herein, non-solvent means that the particles are dispersible, yet substantially insoluble, therein. Separately, a binder solution is prepared by dissolving at least one binder, preferably a thermoplastic elastomer, into at least one solvent. Next, at least a portion of the binder solution in a substantially water-free state and at least a portion of the slurry are mixed, for example by stirring, to coat the particles with the binder so that the particles are immobilized, thereby forming coated igniter granules. A surfactant comprising at least one second non-solvent, which may be the same as or different from the first non-solvent, is then added to the coated igniter granules to harden and reduce agglomeration of the granules. Finally, the coated igniter granules are filtered and dried, preferably at room temperature of from 20° C. to 25° C. The resulting coated igniter granules are substantially uniform in distribution of thermoplastic coating, size, and shape.

Preferably, the method of this invention does not utilize water, so that one or more of the igniter components may be water sensitive, e.g., soluble in water, or moisture sensitive. It is understood, however, that the inventive process can be carried out in a substantially water-free state, meaning that the amount of water introduced during the process is below the solubility limit (i.e., the point at which the particles begin to appreciably dissolve into the water) of the fuel and oxidizer particles dispersed in the non-solvent.

These and other objects, features, and advantages of the present invention will become apparent from the following detailed description when taken in conjunction with the accompanying drawings which illustrate, by way of example, the principles of the present invention.

BRIEF DESCRIPTION OF THE DRAWINGS

The accompanying drawings facilitate by way of illustration an understanding of the principles of this invention. In such drawings.

DETAILED DESCRIPTION OF THE INVENTION

Figure 1:
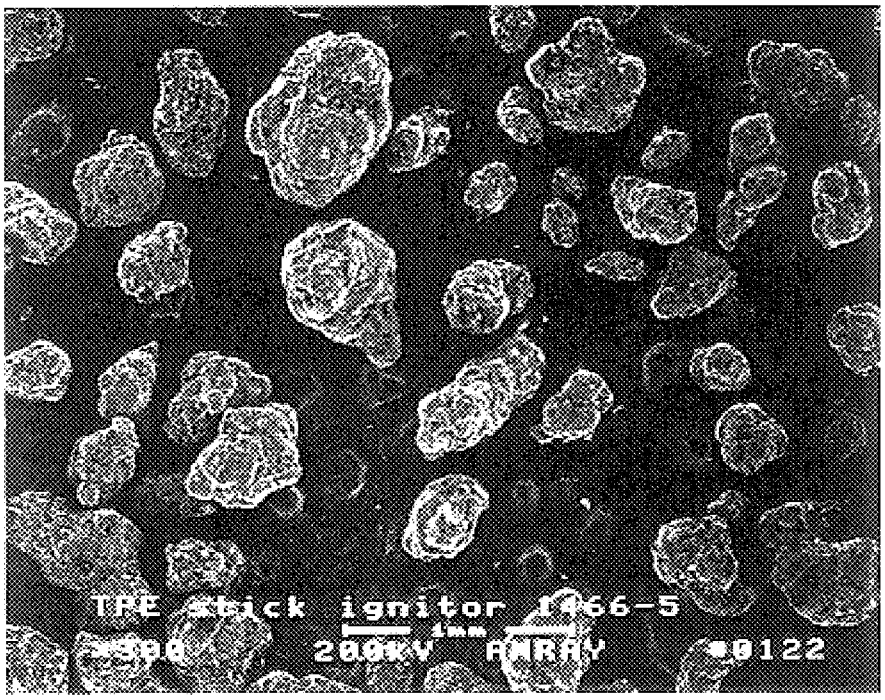
FIG. 1 is a microphotograph taken with a Scanning Electron Miscroscope ("SEM") of igniter granules made in accordance with Example 1 below.

In accordance with an embodiment of the method of this invention, igniter granules are formed by a process which permits the processing of water-sensitive materials, such as magnesium, and the incorporation of the water-sensitive materials into the igniter granule composition.

The binder is preferably a thermoplastic elastomer binder. Representative thermoplastic elastomer binders that may be used in connection with this include, by way of example, nylon, cellulosic-based polymers, polyesters, polyurethanes, polyethers, polyfluorocarbons, silicone, waxes, and copolymers and blends thereof. Other binders are also suitable, so long as the solid fuel and oxidizer constituents are at least substantially homogeneously distributable therein. The binder concentration should be such that a mechanically robust extrudate is obtained. The extrudate, such as an igniter stick, should be capable of retaining its shape, e.g., maintaining its integrity, prior to ignition, and capable of being received (inserted) in a pyrotechnic composition, e.g. a suitably configured bore (e.g. central bore) in a propellant composition, and of shattering or fracturing when ignited. In general, the binder can be in a range of, for example, about 2% by weight to about 15% by weight, and more particularly about 3% by weight to about 7% by weight, relative to the dry ingredients in the igniter composition. The binder can be comprised of more than one binder material.

The igniter composition includes at least one oxidizer. The oxidizer can be organic or inorganic. Organic oxidizers which are dispersable in a binder so that a sufficiently homogeneous igniter composition is obtainable include amine nitrate salts, nitro compounds, and amine perchlorates, of which methyl ammonium nitrate, methyl ammonium perchlorate are exemplary. Inorganic oxidizers include oxidizing ionic species such as nitrates, nitrites, chlorates, and perchlorates. Typifying these inorganic oxidizers are metal nitrates such as potassium nitrate or strontium nitrate, ammonium nitrate, and metal perchlorates such as potassium perchlorate. In general, the oxidizer is ordinarily present in an amount effective to ensure oxidation of at least the fuel in the igniter and can be in a range of, for example, about 70% by weight to about 85% by weight based on the dry ingredients in the formulation.

As the fuel ingredient, representative metals include aluminum, zirconium, boron, magnesium, and/or titanium, as well as combinations and hydrides thereof. The fuels are, by present preference, used in fine particulate form, such as powder or ground to sufficient fine particles, to ensure adequate distribution during the manufacturing process. By preference, an at least substantially uniform distribution in the resultant extrudable igniter composition is desired. In general, the fuel is in pulverulent form, such as about 100 $\mu$m or less, such as, for example, from about 1 $\mu$m to about 30 $\mu$m. Metals in powder form may have, if desired, a smaller particle size range, such as from about 1 $\mu$m to about 20 $\mu$m, or even smaller such as about 1 $\mu$m to about 5 $\mu$m. The fuels can be added in substantially uniform particle size distribution, or in multi-modal distributions depending on the ignition characteristics desired. The amount of fuel—other than the binder—can be in a range of, for example, about 5% by weight to about 30% by weight, and more particularly about 10% by weight to about 20% by weight, relative to the dry ingredients in the formulation.

Preferred fuel/oxidizer combinations include, by way of example, boron/potassium nitrate, boron/potassium perchlorate, magnesium/TEFLON, zirconium/potassium perchlorate, and tracer igniter compositions including strontium peroxide, calcium resinate, and magnesium. Preferably, the igniter composition comprises boron and potassium nitrate.

Examples of plasticizers that may be used in combination with the binder include acetyltriethylcitrate ("ATEC"), which is preferably used with nylon, isodecylpelargonate ("IDP"), dioctyladipate ("DOA"), and bis-dinitropropyl acetal/bis-dinitropropyl formal ("BDNPA/F"). Other inert plasticizers that can be used include DOP (dioctylphthalate), DOM (dioctylmaleate), DBP (dibutylphthalate), oleyl nitrile, or mixtures thereof. Representative energetic plasticizers include TMETN (trimethylolethanetrinitrate), TEGDN (triethyleneglycoldinitrate), DEGDN (diethyleneglycol-dinitrate), NG (nitroglycerine), BTTN (butanetrioltrinitrate), alkyl NENA's (nitratoethylnitramine), or mixtures thereof.

Reinforcements can also be incorporated into the igniter compositions. Suitable reinforcements include fibers, especially KEVLAR fibers, which serve to strengthen the granules and, upon appropriate selection of the reinforcement, improve igniter performance. Other fillers that may be useful with this invention include polyolefin fibers, polyamide fibers, polyester fibers, and poly(2,2-(m-phenylene-)-5,5-bisbenzimidazole (PBI) fibers. It is also envisioned that nitramines, such as RDX, HMX, and CL-20 may be used in the igniter composition as supplemental oxidizers.

Preferred characteristics for the non-solvent(s) in which the fuel and oxidizer particles are dispersed include the absence of functional groups which are reactive with the igniter ingredients, especially polyols, peroxy groups, and fluoro groups that can decompose to form fluorine. The non-solvent also should not contribute a significant vapor pressure. The boiling point of the non-solvent should not be less than the operating temperature of the process, and preferably is above about 60° C. so that minimal amounts of the non-solvent escape via evaporation at room temperature. For example, for an igniter composition comprising boron and potassium nitrate, straight chain or cyclic aliphatic compounds are preferred, especially hexane, cyclohexane, heptane, and/or cycloheptane. Most preferably heptane is selected as the non-solvent.

The liquid in which the fuel and oxidizer particles are dispersed may comprise more than one non-solvent, and may include other ingredients, such as surfactants. Methanol is an example of a useful surfactant. Because some fuel and oxidizer particles solubilize in excess surfactant, the surfactant (and other ingredients in the liquid medium) should not be present in a sufficient amount to cause the particles to dissolve therein.

A binder solution or lacquer comprising a thermoplastic elastomer, optionally a plasticizer, and at least one organic solvent is separately prepared. The binder solution should contain a sufficient amount of solvent to dissolve substantially all of the thermoplastic elastomer binder and plasticizer into solution. By way of example, when nylon is selected as the binder material, the preferred solvent is methanol. Other useful solvents include ethyl acetate, tetrahydrofuran, toluene, ethanol, chlorinated solvents (e.g., methylene chloride) and isopropanol, and mixtures thereof.

The slurry and binder solution are preferably mixed together with stirring or other mixing technique in order to coat the fuel and oxidizer particles with thermoplastic elastomer binder. The ratio of slurried material to binder solution is preferably selected to produce a composition comprising from about 85 wt % to about 98 wt % ignition materials (i.e., the combination of the oxidizer and fuel), and more preferably about 92 wt % to about 98 wt % ignition materials. For example, where boron/potassium nitrate is selected as the ignition material and nylon is selected as the binder, the resulting composition preferably contains from about 15 wt % to about 18 wt % boron, from about 77 wt % to about 80 wt % potassium nitrate, and from about 2 wt % to about 8 wt % nylon binder. Where heptane is selected as the non-solvent of the slurry and methanol as the solvent of the binder solution, the weight ratio of non-solvent to solvent is preferably from about 7:1 to about 11:1. Similar concentrations and ratios may be used for other igniter material ingredients.

As the combination of the slurry and binder solution are being stirred to form coated ignitable particles (or ignition granules), a second portion of non-solvent is added to harden the igniter granules, prevent agglomeration, and aid in removing the granules from the reaction slurry vessel. The coated granules are then filtered under vacuum and dried at room temperature of from 20° C. to 25° C.

In the present process, it is possible to control the size and general shape of the granules by controlling the rate at which the second liquid medium is added to the slurry, the impeller speed, and the ratio between the non-solvents to solvents. Small irregular shaped granules may be produced by adding the binder solution gradually, setting a high impeller rate, and selecting a relatively high weight ratio of the non-solvent to solvent, such as about 8.5:1. Larger and more regularly shaped granules are produced by adding the binder solution rapidly, setting a low impeller rate, and selecting a relatively low weight ratio of the non-solvents to solvents, such as about 8.0:1.

The igniter granules produced by the method of this invention can be utilized for various pyrotechnic ordnances such as, for example, igniters for solid-propellant rocket motors, automotive gas generant systems, and decoy flares. The extrudable igniter composition can be used to form a solid or hollow igniter "stick" capable of igniting a flare or propellant composition in a flare or other pyrotechnic device. The general construction and operation of stick igniters is described in U.S. Pat. Nos. 3,062,147 and 3,899,973, the complete disclosures of which are incorporated herein by reference to the extent that they are compatible with this invention, and Encyclopedia of Chemical Technology, 20:680–697 ($4^{th}$ Edition 1996). Extrusion and extruders are described generally in Encyclopedia of Polymer Science and Engineering, 16:570–631 ($2^{nd}$ Edition 1996). The extruded igniter of this invention can have configurations other than that of a stick, provided the configuration is consistent with the objectives herein disclosed.

Figure 7:
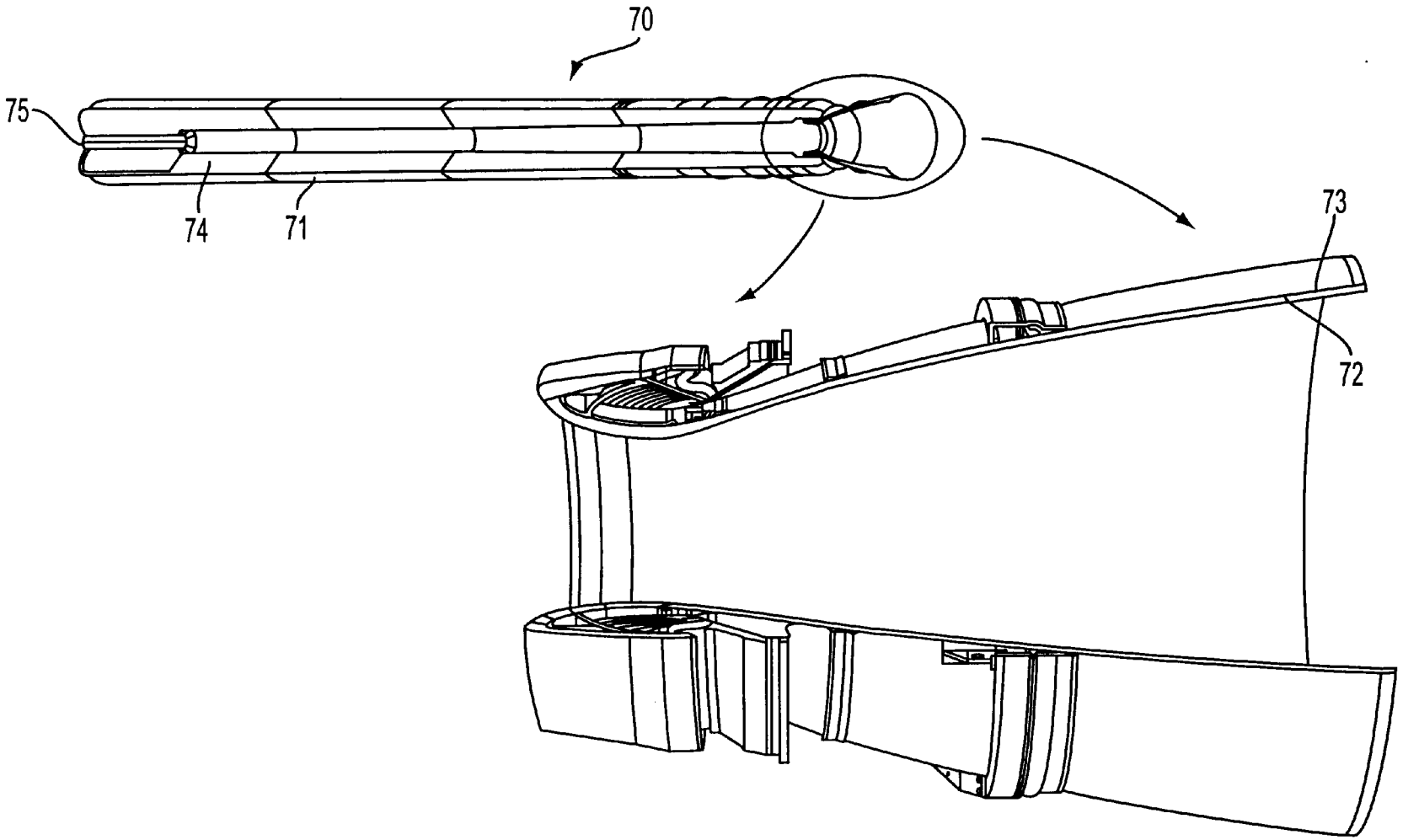
FIG. 7 is a schematic sectional view of a solid propellant rocket motor assembly containing the igniter granules of this invention.

An example of a rocket motor assembly 70 including a stick igniter made in accordance with the principles of this invention is shown in FIG. 7. The assembly includes a rocket motor case 71. Disposed in protective arrangement on an internal surface of the rocket motor case 71 is an ablative insulation 72, shown in a cured state. Typically, a liner 73 is interposed between the case 71 and the insulation 72. A propellant grain 74 is loaded within the case 71. The propellant grain 74 is a center perforated grain. It is to be understood that the center perforation can undertake various configurations known in the art, including those having circular, cross, and star-shaped cross sections. The insulation 72 and liner 73 serve to protect the case 71 from the extreme conditions produced by the burning propellant 74. Methods for loading a rocket motor case 71 with an insulation 72, liner 73, and propellant 74 are known to those skilled in the art, and can be readily adapted within the skill of the art without undue experimentation to incorporate the insulation of this invention. Liner compositions and methods for applying liners into a rocket motor case are also well known in the art, as exemplified by U.S. Pat. No. 5,767,221, the complete disclosure of which is incorporated herein by reference.

An ignition stick 75 is positioned at the forward end of the case 71 within the center of the propellant 74 for ignition of the propellant 74. At the aft end of the case is a converging-diverging nozzle assembly 76 through which combustion products are expelled. Finally, a squib and ignition lead (not shown) are operatively connected to the ignition stick 75 to initiate the ignition sequence. The ignition stick 75 is sized to be capable of complete end-to-end ignition, e.g., complete flame transition, in a short time, such as less than 10 milliseconds. Ignition of the igniter stick 75 (via the squib) causes combustion products of the stick 75 to contact and ignite the perforation-defining surface of the propellant 74, thus uniformly igniting the propellant 74, which burns from the perforation-defining surface radially outward towards the insulation 72 and liner 73.

The igniter sticks can be used with larger sized solid propellant launch vehicles, such as solid propellant rockets. Solid propellant rockets which can be equipped with at least one igniter stick as at least part of the ignition system include those described in Solid Rocket Propulsion Technology (Pergamon Press, $1^{st}$ Edition 1993) and Rocket Propulsion Elements (Wiley Interscience, 4th Edition 1976), the disclosures of which are incorporated herein to the extent that they are compatible with this invention.

Figure 8:
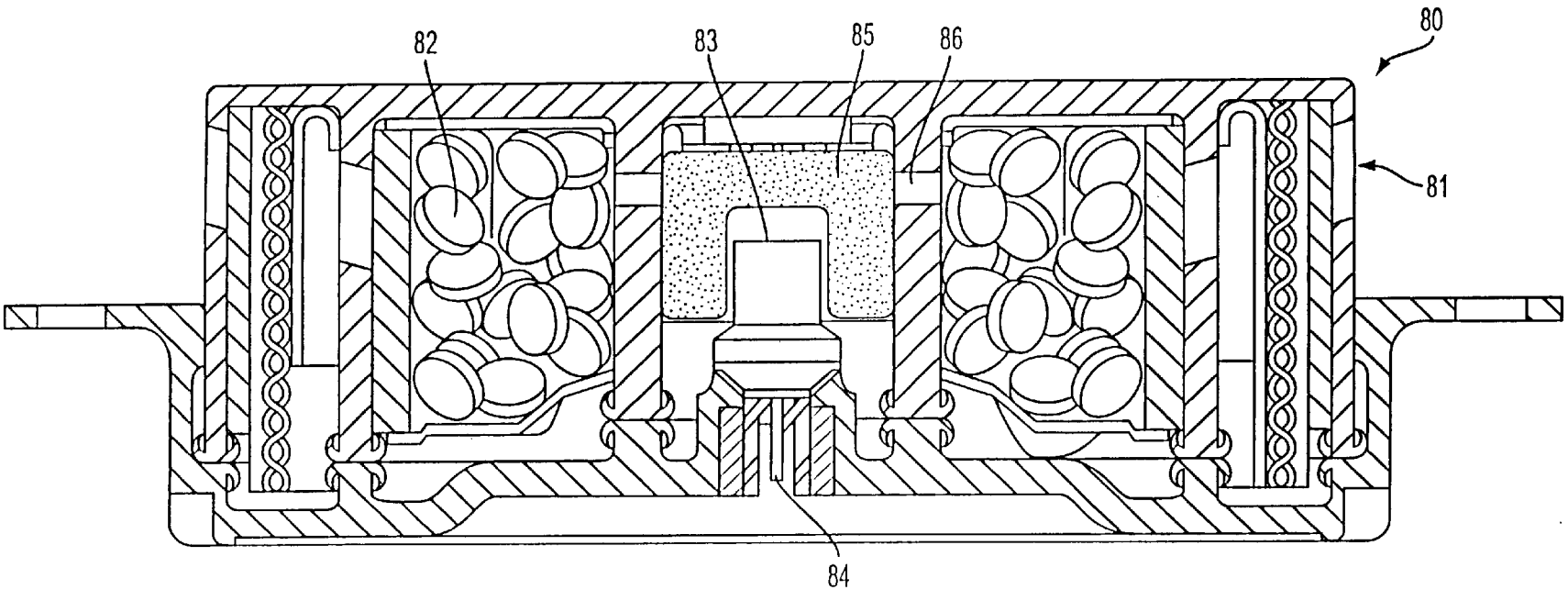
FIG. 8 is a schematic sectional view of an air bag assembly containing the igniter granules of this invention.

An automotive inflatable air bag assembly which may be used in combination with the igniter granules of this invention is shown in FIG. 8 and generally designated by reference numeral 80. The illustrated air bag assembly 80 comprises a housing 81 containing a plurality of gas generant pellets 82. Concentrically located within the chamber accommodating the gas generant pellets 82 is a squib 83 having electrical lead wires 84. The squib 83 is surrounded by the extruded igniter granules 85 of this invention.

In operation, an electrical charge sent to the squib 83 via the electrical lead wires 84 ignites the igniter 85, which sends hot gas through apertures 86 located in the housing 81. The hot gas serves to activate the gas generant pellets 82, which generate gas needed to inflate a folded air bag (not shown). As is seen from this embodiment, the igniter material made in accordance with the present invention may be extruded into a form other than that of a stick.

The gas generant pellets 82 may be from various known and novel materials suited for inflating an air bag. Representative gas generant 82 materials that may be used with the igniter of this invention include, by way of example, sodium azide gas generating compositions and sodium-azide-free compositions, including the following: compositions comprising oxidizable borohydride fuels as disclosed in U.S. Pat. No. 5,401,340; compositions comprising basic metal carbonates and/or basic metal nitrates as disclosed in U.S. Pat. No. 5,429,691 and U.S. Pat. No. 5,439,537; gas generant compositions containing non-metallic salts of 5-nitrobarbituirc acid, as disclosed in U.S. Pat. No. 5,472,534; anhydrous tetrazole gas generant compositions as disclosed in U.S. Pat. Nos. 5,472,647, 5,500,059, 5,501,823, and 5,516,377; and compositions comprising metal complexes as disclosed in U.S. Pat. Nos. 5,592,812 and 5,725,699. To the extent that the compositions of these United States patents are compatible for use with the inventive igniter, the complete disclosures of these patents are incorporated herein by reference. These gas generant materials are processible, and can be pressed into pellet or other usable form.

The air bag assembly may be of a conventional design. Therefore, the conventional portions of the assembly need not and will not be described in any greater detail herein. The igniter material can also be used for a side impact and/or head impact supplemental restraint system. A general discussion of the structure and operation of such a supplemental restraint system is set forth in U.S. Pat. Nos. 5,441,303 and 5,480,181. To the extent that these referenced systems are compatible with the invention, the complete disclosures of these United States patents are incorporated herein by reference. These referenced restraint systems are mentioned by way of example only to depict the general construction and operation of known systems. This invention is not limited to such systems.

The inventive igniter is readily adaptable for use with conventional hybrid air bag inflator technology. Hybrid inflator technology is based on heating a stored inert gas (argon or helium) to a desired temperature by burning a small amount of propellant. Hybrid inflators do not require cooling filters used with pyrotechnic inflators to cool combustion gases, because hybrid inflators are able to provide a lower temperature gas. The gas discharge temperature can be selectively changed by adjusting the ratio of inert gas weight to propellant weight. The higher the gas weight to propellant weight ratio, the cooler the gas discharge temperature.

A hybrid gas generating system comprises a pressure tank having a rupturable opening; a pre-determined amount of inert gas disposed within that pressure tank; a gas generating device for producing hot combustion gases and having means for rupturing the rupturable opening; and means for igniting the gas generating composition. The tank has a rupturable opening which can be broken by a piston when the gas generating device is ignited. The gas generating device is configured and positioned relative to the pressure tank so that hot combustion gases are mixed with and heat the inert gas. Suitable inert gases include, among others, argon and helium and mixtures thereof. The mixed and heated gases exit the pressure tank through the opening and ultimately exit the hybrid inflator and deploy the airbag.

Hybrid gas generating devices for supplemental safety restraint applications are described in Frantom, Hybrid Airbag Inflator Technology, Airbag Int'l Symposium on Sophisticated Car Occupant Safety Systems (Weinbrenner-Saal, Germany, Nov. 2–3, 1992).

Figure 9:
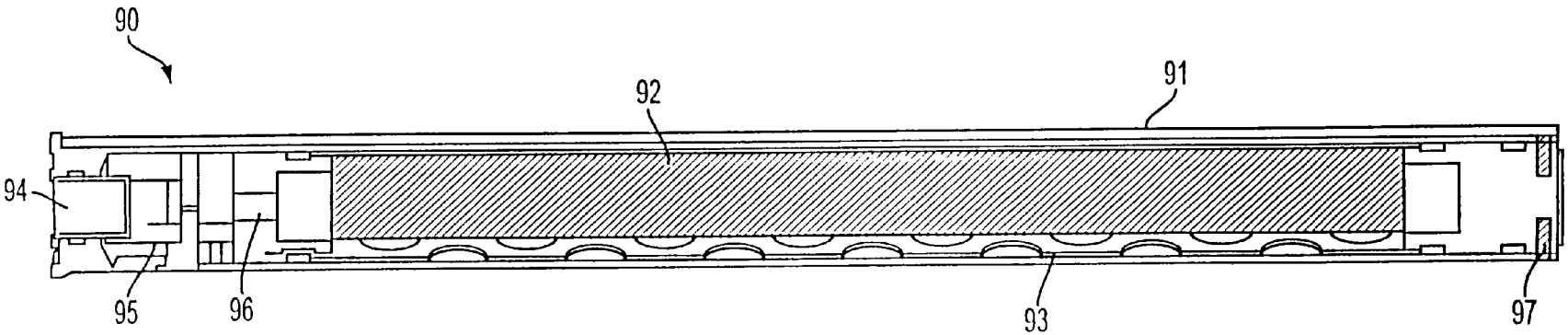
FIG. 9 is a schematic sectional view of a decoy flare assembly containing the igniter granules of this invention.

Igniter sticks can be used in a great number of decoy devices which include decoy flares which are deployed to defend against an incoming threats, and particularly against heat-seeking missiles. FIG. 9 depicts a decoy flare assembly 90, which includes a cartridge case 91 and a solid-propellant grain 92 concentric therewith and extending over a portion of the length of the cartridge case 91. A perforated tube 93 surrounds the outer surface of the propellant grain 92, and is positioned inside of the cartridge case 91. An impulse cartridge 94 is provided at one end of the cartridge case 91, and is in cooperative association with a movable piston 95. Interposed between the piston 95 and the propellant grain 92 is the igniter 96.

In operation, the impulse cartridge 94 contains one or more pyrotechnics (not shown), which are fired by an electric charge. Upon firing, the impulse cartridge 94 releases hot gas, which expands against the piston 95, causing the piston 95 to eject the propellant grain 92 and perforated tube 93 from the cartridge case 91. The force provided by the expanding piston 95 causes retention pins 97 to be fractured, thereby allowing the grain 92 and tube 93 to escape from the cartridge case 91. Simultaneously, the igniter 96 is ignited, and bums along the length of grooves in the propellant grain 92 until the flame is transferred to the propellant grain 92. The perforated tube 93 is provided with crimped ends to retain the propellant grain 92 therein.

The well-known Jane's Handbook describes flares and other solid propellant devices suitably used in combination with igniter sticks.

With the exception of the igniter material disclosed herein, the rocket motor, air bag, and decoy flare assemblies may be of a conventional design and can be constructed using engineering principles commonly known to those of ordinary skill in the art to which this invention pertains. Therefore, the conventional portions of the assemblies need not and will not be described in any greater detail herein.

The following examples serve to explain embodiments of the present invention in more detail, and are not to be considered as exclusive or exhaustive as to the scope of this invention.

EXAMPLES

Example 1

A slurry was prepared in a one liter slurry beaker by charging into the beaker 180 grams of heptane, 2.5 grams of methanol, 38.5 grams of ground $KNO_3$, and 9.0 grams of boron powder. The slurry was stirred with an air-driven impeller at 400–600 rpm at 30° C. In a separate vessel, 2.5 grams of M548 (95 wt % 6/6.6/11/12 nylon, 4 wt % caprolactam), supplied by Elf Atochem, were dissolved in 10.0 grams of methanol to create a binder solution, which was then slowly added at an addition rate of approximately 0.5–1.0 g/min while stirring the igniter composition. The vessel in which the binder solution was prepared was rinsed with 5 grams of methanol, which were then added to the slurry. An air sweep was then placed over the slurry mix via a vacuum pump for 10 minutes. After five minutes, 50 ml of heptane was added. The heptane was then filtered from the particles, and the particles were dried on filter paper at room temperature. A photomicrograph of the particles taken with a Scanning Electron Microscope (SEM) is shown in FIG. 1.

Yield: 48.8 g of granules.

Size Distribution: 31 wt % 850–425 $\mu$m; 52 wt % 425–212 $\mu$m; and 16 wt % less than 212 $\mu$m.

Example 2

Figure 2:
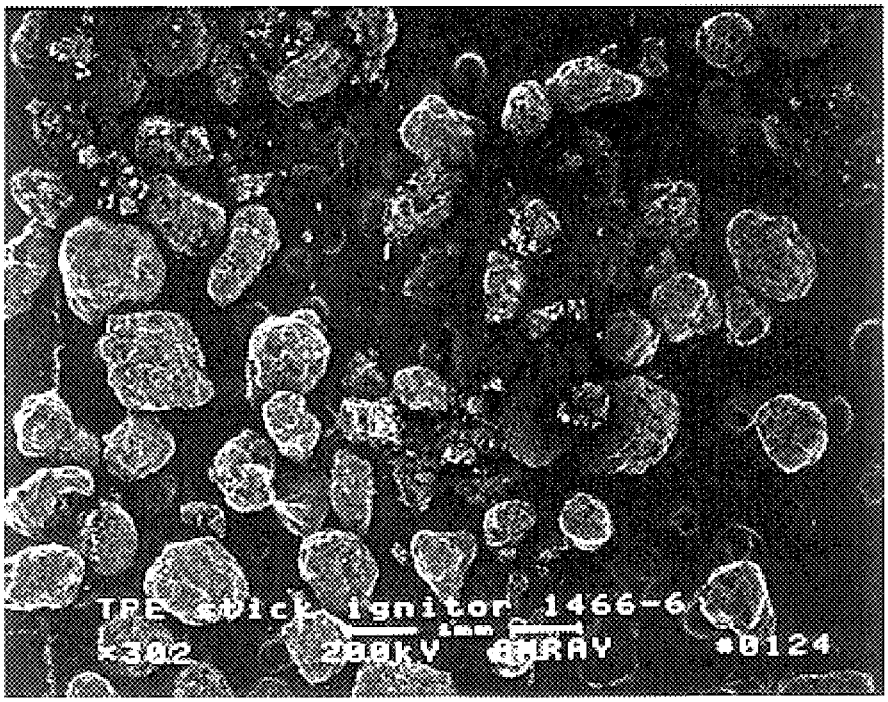
FIG. 2 is a microphotograph taken with a SEM of igniter granules made in accordance with Example 2 below.

A slurry was prepared in a one liter slurry beaker by charging the beaker with 180 grams of heptane, 6.0 grams of methanol, 38.5 grams of ground $KNO_3$, and 9.0 grams of boron powder. The mixture was stirred with an air-driven impeller at 400–600 rpm at 30° C. In a separate vessel, 2.0 grams of M548 and 0.5 g of isodecyl pelargonate ("IDP") was dissolved in 10.0 grams of methanol to form a binder solution, which was then slowly added to the stirred slurry at an addition rate of approximately 0.5–1.0 g/min. The vessel in which the binder solution was prepared was then rinsed with 4.5 grams of methanol, which was also added to the slurry. An air sweep was then placed over the slurry mix via a vacuum pump for 10 minutes. After five minutes, 50 ml of heptane was added. The heptane was then filtered from the particles, and the particles were dried on filter paper at room temperature. A photomicrograph of the particles taken with a SEM is shown in FIG. 2.

Yield: 48.6 g of granules.

Size Distribution: 23 wt % 850–425 μm; 61 wt % 425–212 μm; and 15 wt % less than 212 μm.

Example 3

Figure 3:
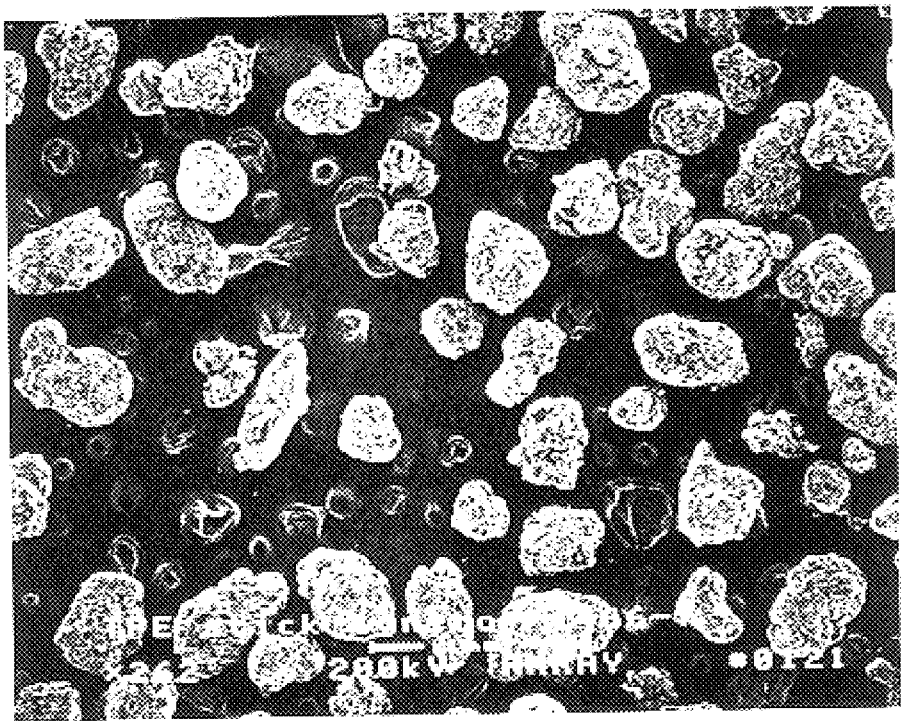
FIG. 3 is a microphotograph taken with a SEM of igniter granules made in accordance with Example 3 below.

A slurry was prepared in a one liter slurry beaker by charging the beaker with 180 grams of heptane, 6.0 grams of methanol, 38.5 grams of ground $KNO_3$, and 9.0 grams of boron powder. The slurry was stirred with an air-driven impeller at 400–600 rpm at 30° C. In a separate vessel, 2.0 grams of M548 and 0.5 grams of acetyltriethylcitrate (available from Morflex, Greensboro, N.C.) were dissolved in 10.0 grams of methanol to form a binder solution, which was then slowly added to the slurry at an addition rate of approximately 0.5–1.0 g/min. The vessel in which the binder solution was prepared was then rinsed with 4.0 grams of methanol, which was then added to the slurry. An air sweep was then placed over the slurry mix via a vacuum pump for 10 minutes. After five minutes, 50 ml of heptane was added. The heptane was then filtered from the particles, and the particles were dried on filter paper at room temperature. A photomicrograph of the particles taken with a SEM is shown in FIG. 3.

Yield: 48.1 g of granules.

Size Distribution: 12 tw % 850–425 μm; 71 tw % 425–212 μm; and 17 wt % less than 212 μm.

Example 4

Figure 4:
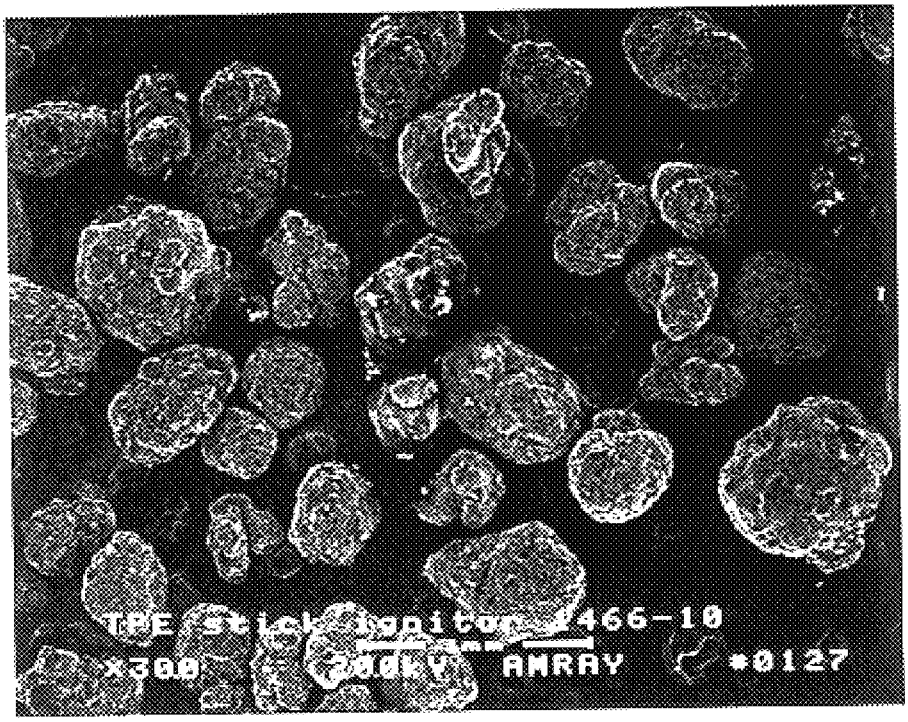
FIG. 4 is a microphotograph taken with a SEM of igniter granules made in accordance with Example 4 below.

A one liter slurry beaker was coated by spraying with tetrafluoroethylene ("TFE"). The coated slurry beaker was charged with 188 grams of heptane, 12.0 grams of methanol, 7.5 grams of boron powder, and 40 grams of ground $KNO_3$ to prepare a slurry, which was mixed at 30° C. A binder solution was prepared in a separate vessel by dissolving 2.0 grams of M548 and 0.5 grams of acetyltriethyl citrate ("ATEC") in 10 grams of methanol. The binder solution was slowly added to the slurry at an addition rate of approximately 0.5–1.0 g/min and stirred for five minutes. An air sweep was then placed over the slurry mix via a vacuum pump for 5 minutes. Additional heptane (50 ml) was added to the reaction mixture. Stirring was stopped, and the granules were filtered and washed with heptane. The granules were then allowed to dry at room temperature. A photomicrograph of the particles taken with a SEM is shown in FIG. 4.

Yield: 49.0 g of granules.

Size Distribution: 23 wt % 850–425 μm; 74 wt % 425–212 μm; and 2 wt % less than 212 μm.

Example 5

Figure 5:
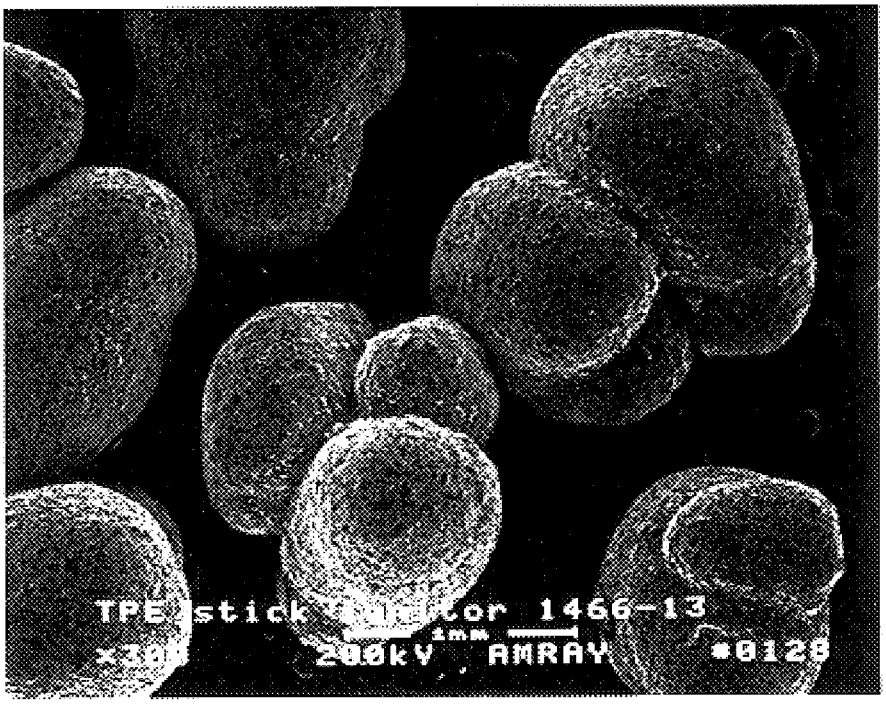
FIG. 5 is a microphotograph taken with a SEM of igniter granules made in accordance with Example 5 below.
Figure 6:
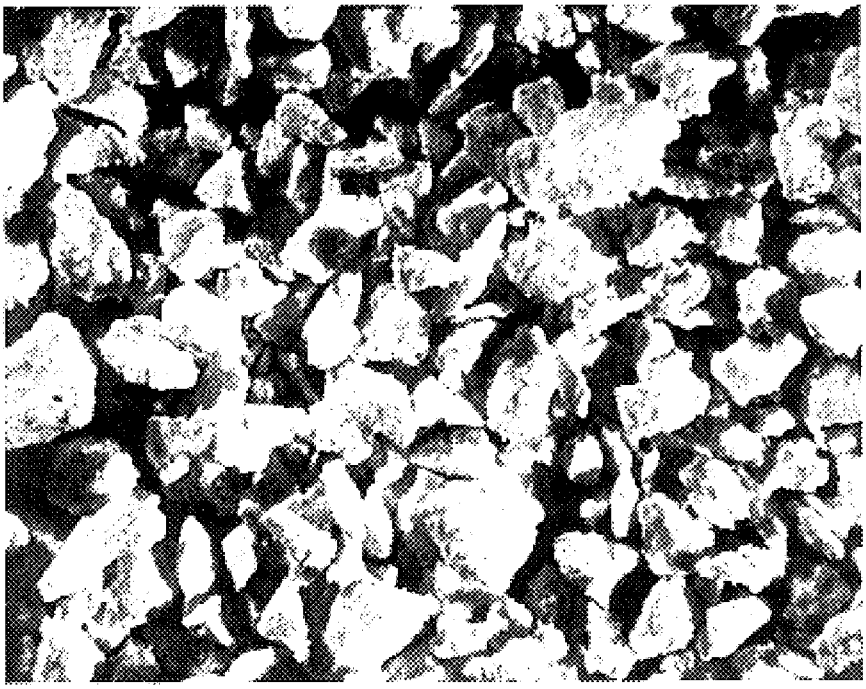
FIG. 6 is a microphotograph taken with a SEM of igniter granules made in accordance with Comparative Example A below.

A one liter slurry beaker was coated by spraying with TFE. The coated slurry beaker was charged with 196.4 grams of heptane, 7.5 grams of boron powder, and 40 grams of ground $KNO_3$ to form a slurry, which was mixed at 30° C. Then, 13.6 grams of methanol were added and the mixture was stirred. In a separate beaker 2.0 grams of M548 and 0.5 grams of ATEC were dissolved in 10 g methanol to form a binder solution, which was slowly added to the slurry at an addition rate of approximately 0.5–1.0 g/min. The beaker in which the binder solution was prepared was rinsed with 1 grams of methanol and the rinsings were added to the slurry. While continuing stirring, an air sweep was placed over the slurry mix via a vacuum pump for 5–10 minutes. 50 ml heptane was added. Stirring was stopped, and granules were filtered off and dried at room temperature. A photomicrograph of the particles taken with a SEM is shown in FIG. 5.

Yield: 43.9 g of granules.

Size Distribution: 79 wt % 850–425 μm; and 21 wt % 425–212 μm.

Comparative Example A

In a 1 liter beaker, 2 grams of nylon binder (M548 ) and 0.5 gram of plasticizer (IDP) were dissolved in an 10.0 grams of methanol to form a lacquer. To the lacquer was added a filler material of 38.5 grams of $KNO_3$ and 9.0 grams of boron powder while stirring, while 200 grams of methanol was added to maintain a very low viscosity and promote thorough coating of the filler by the binder. After all of the filler was added, stirring was continued and solvent was removed with an air sweep, which was created by a vacuum pump. Enough solvent was removed to form a high viscosity paste, which was pressed against a screen (20–25 mesh (710–850 μm)) to granulate the material. The granules were spread in a thin layer on a tray and dried at a temperature 60° C., which was sufficient to efficiently remove the solvent.

From FIGS. 1–6, it is seen that the granules produced from the inventive examples 1–5 were much more rounded and did not agglomerate as much as the granules of comparative example 6. As a consequence, the granules of the inventive examples are believed to have lower sensitivity and high packing density than the granules of the comparative example.

The foregoing detailed description of the embodiments of the invention has been provided for the purposes of illustration and description. It is not intended to be exhaustive or to limit the invention to the precise embodiments disclosed. The embodiments were chosen and described in order to best explain the principles of the invention and its practical application, thereby enabling others skilled in the art to understand the invention. While the invention has been described in connection with what is presently considered to be the most practical and preferred embodiments; it is understood that the invention is not limited to the disclosed embodiments, but, to the contrary, is intended to cover various modifications and equivalent arrangements included within the spirit and scope of the appended claims.

What is claimed is:

1. A method of preparing extrudable igniter granules suitable for waterless extrusion, the method comprising:

preparing a substantially water-free slurry comprising fuel particles and oxidizer particles dispersed in a liquid comprising at least one first non-solvent, wherein the fuel particles and the oxidizer particles are substantially insoluble in the liquid, and wherein at least one member selected from the group consisting of the fuel particles and the oxidizer particles is water sensitive;

separately dissolving at least one thermoplastic elastomer binder into at least one solvent to form a binder solution;

mixing at least a portion of the binder solution in a substantially water-free state with at least a portion of the slurry to form a mixture comprising the fuel particles and the oxidizer particles dispersed in the binder solution;

combining at least one second non-solvent with the mixture, wherein the fuel particles and the oxidizer particles are substantially insoluble in the second non-solvent; and forming the extrudable igniter granules, the extrudable igniter granules comprising the fuel particles and the oxidizer particles coated with the thermoplastic elastomer binder.

2. The method of claim 1, further comprising filtering and drying the igniter granules at room temperature in a range of from 20° C. to 25° C.

3. The method of claim 1, wherein the first and second non-solvents are identical.

4. The method of claim 1, wherein the first and second non-solvents each comprise at least one member selected from the group consisting of hexane, heptane, cyclohexane, and cycloheptane.

5. The method of claim 1, wherein the solvent comprises a member selected from the group consisting of methanol, ethyl acetate, tetrahydrofuran, toluene, ethanol, isopropanol, and chlorinated solvents.

6. The method of claim 1, wherein the fuel and oxidizer particles comprise at least one combination selected from the group consisting of boron/potassium nitrate, boron/potassium perchlorate, magnesium/TEFLON, zirconium/potassium perchlorate, and tracer igniter compositions including strontium peroxide, calcium resinate, and magnesium.

7. The method of claim 1, wherein the fuel and oxidizer particles comprise boron/potassium nitrate.

8. The method of claim 1, wherein the binder solution further comprises at least one plasticizer selected from the group consisting of acetyltriethylcitrate, isodecylpelargonate, dioctyladipate, and bisdinitropropyl acetal/bis-dinitropropyl formal.

9. The method of claim 1, wherein the thermoplastic elastomer binder comprises at least one member selected from the group consisting of nylon, cellulosic-based polymers, polyesters, polyurethanes, polyethers, polyfluorocarbons, silicone, waxes, and copolymers thereof.

10. The method of claim 1, wherein the fuel particles and oxidizer particles comprise a combination of boron potassium nitrate, and wherein the binder solution further comprises dioctyladipate as a plasticizer.

11. The method of claim 1, wherein the slurry and binder solution are water free.

12. The method of claim 1, further comprising adding at least one surfactant to the substantially water-free slurry.

13. A method of making a secondary restraint inflation device for a vehicle, the secondary restraint inflation device comprising an air bag and a housing containing an electrical charge-delivering squib and a gas generant, said method comprising:

preparing igniter granules by the method of claim 1;

extruding the igniter granules to form an igniter; and placing the igniter in cooperative relation with the electrical charge-delivering squib and the gas generant so that delivery of an electrical charge to the squib causes ignition of the igniter, which in turn ignites the gas generant to produce sufficient gas to inflate the air bag.

14. The method of claim 13, wherein said extruding of the igniter granules comprises waterless extrusion.

15. A method of making a solid propellant rocket motor comprising an outer casing, a nozzle assembly, a propellant grain loaded in the casing, and insulation interposed between the casing and the propellant grain, said method comprising:

preparing igniter granules by the method of claim 1;

extruding the igniter granules to form an igniter; and placing the igniter in cooperative relation with a squib and the propellant grain so that delivery of a charge to the squib causes ignition of the igniter, which in turn ignites the propellant grain to produce sufficient combustion products to propel the rocket motor as the combustion products are expelled through the nozzle assembly.

16. The method of claim 15, wherein the igniter comprises an igniter stick.

17. The method of claim 15, wherein said extruding of the igniter granules comprises waterless extrusion.

18. A method of making a decoy flare assembly comprising an outer casing, a nozzle assembly, a propellant grain loaded in the casing, an impulse cartridge, and insulation interposed between the casing and the propellant grain, said method comprising:

preparing igniter granules by the method of claim 1;

extruding the igniter granules to form an igniter; and placing the igniter in cooperative relation with an impulse cartridge and a solid propellant so that actuation of the impulse cartridge ignites the igniter, which in turn ignites the solid propellant.

19. The method of claim 18, wherein the igniter comprises an igniter stick.

20. The method of claim 18, wherein said extruding of the igniter granules comprises waterless extrusion.

* * * * *